US008066273B2

(12) United States Patent
Connell et al.

(10) Patent No.: US 8,066,273 B2
(45) Date of Patent: Nov. 29, 2011

(54) DUAL-STACK DOCUMENT STORAGE BIN FOR USE IN A SELF-SERVICE BUNCH DOCUMENT DEPOSITING TERMINAL

(75) Inventors: Brian P. Connell, Waterloo (CA); Fredrik L. N. Kallin, Waterloo (CA); David W. Norris, Cambridge (CA); Robin I. G. Angus, Fife (GB)

(73) Assignee: NCR Corporation, Duluth, GA (US)

( * ) Notice: Subject to any disclaimer, the term of this patent is extended or adjusted under 35 U.S.C. 154(b) by 21 days.

(21) Appl. No.: 12/641,675

(22) Filed: Dec. 18, 2009

(65) Prior Publication Data

US 2011/0148029 A1 Jun. 23, 2011

(51) Int. Cl.
*B65H 3/44* (2006.01)
*B65H 5/26* (2006.01)

(52) U.S. Cl. ..... 271/9.08; 271/9.12

(58) Field of Classification Search ..... 271/279, 271/299, 9.12, 9.08, 292, 215; 109/53; 221/198
See application file for complete search history.

(56) References Cited

U.S. PATENT DOCUMENTS 4,625,641 A * 12/1986 Jagosz et al. ..... 101/240
5,096,181 A * 3/1992 Menon et al. ..... 271/157
5,282,612 A * 2/1994 Gerlier ..... 271/9.12
5,803,446 A * 9/1998 Leuthold et al. ..... 271/9.08
6,352,254 B1 * 3/2002 Kimura et al. ..... 271/9.12
7,823,869 B2 * 11/2010 Ise ..... 271/9.03
7,866,654 B2 * 1/2011 Ohno ..... 271/9.08

* cited by examiner

*Primary Examiner* — Kaitlin Joerger
(74) *Attorney, Agent, or Firm* — Paul W. Martin

(57) ABSTRACT

A dual-stack document storage bin comprises a substantially U-shaped container including a first bottom wall which interconnects first and second sidewalls to provide (i) the substantially U-shape, and (ii) a first document storage chamber which is defined between the first and second sidewalls and into which documents can be stacked to form a first stack of documents when the U-shaped container is in a first position. The dual-stack document storage bin further comprises a substantially L-shaped housing including a second bottom wall and a third sidewall which is disposed relative to the second bottom wall to provide (i) the substantially L-shape, and (ii) a second document storage chamber which is defined between the third side wall and the second sidewall and into which documents can be stacked to form a second stack of documents when the U-shaped container is in a second position which is different from the first position. The dual-stack document storage bin also comprises a mechanism operatively coupled between the first and second bottom walls to support substantially horizontal sliding movement of the U-shaped container between the first position in which documents can be stacked onto the first stack of documents in the first document storage chamber and the second position in which documents can be stacked onto the second stack of documents in the second document storage chamber.

10 Claims, 10 Drawing Sheets

DUAL-STACK DOCUMENT STORAGE BIN FOR USE IN A SELF-SERVICE BUNCH DOCUMENT DEPOSITING TERMINAL

BACKGROUND OF THE INVENTION

The present invention relates to stacking deposited documents in a self-service environment, such as stacking checks and currency notes which have been deposited at an automated teller machine (ATM), and is particularly directed to a dual-stack document storage bin for use in a self-service bunch document depositing terminal, such as a bunch document depositing automated teller machine (ATM).

In a typical bunch document depositing ATM, an ATM customer is allowed to deposit a bunch of documents of the same type such as currency notes or checks (without having to place any of the documents in a deposit envelope) in a publicly accessible, unattended environment. To deposit a bunch of documents, the ATM customer inserts a user identification card through a user card slot at the ATM, enters the amount of the bunch of documents being deposited, and inserts the bunch of documents to be deposited through a slot of a bunch document acceptor module. A document transport mechanism receives the inserted bunch of documents and transports the documents one-by-one in a forward direction along a document transport path to a number of locations within the ATM to process the documents.

If a particular document is not accepted for deposit, the document transport mechanism transports the entire bunch of documents in a manner to return the bunch of documents to the ATM customer. If the entire bunch of documents is accepted for deposit, the amount of the bunch of documents is deposited into the ATM customer's account and the documents are transported one-by one to a number of document storage bins within the ATM. If a bunch of documents is a bunch of checks, an endorser printer prints an endorsement onto each check as the check is being transported to and stored in a check storage bin. If a bunch of documents is a bunch of currency notes, then each currency note is transported to and stored in a currency storage bin. Documents in the different storage bins are periodically picked up and physically transported via courier to a back office facility of a financial institution for further processing.

Each of the check storage bin and the currency storage bin is a type of document storage bin which may be of the same construction. Both document storage bins are usually located inside of a pocketing module. The pocketing module is usually located below the bunch document acceptor module. If additional document storage capacity is desired (e.g., additional check storage capacity or currency storage capacity is desired), then another document storage bin is added to the pocketing module. A drawback in adding another document storage bin to the pocketing module is that additional hardware for the document transport mechanism and another document storage bin are needed. It would be desirable to provide a type of document storage bin in which document storage capacity (i.e., either check storage capacity or currency storage capacity, or both) is increased without having to add another document storage bin to the pocketing module.

SUMMARY OF THE INVENTION

In accordance with one embodiment of the present invention, a dual-stack document storage bin comprises a substantially U-shaped container including a first bottom wall which interconnects first and second sidewalls to provide (i) the substantially U-shape, and (ii) a first document storage chamber which is defined between the first and second sidewalls and into which documents can be stacked to form a first stack of documents when the U-shaped container is in a first position. The dual-stack document storage bin further comprises a substantially L-shaped housing including a second bottom wall and a third sidewall which is disposed relative to the second bottom wall to provide (i) the substantially L-shape, and (ii) a second document storage chamber which is defined between the third side wall and the second sidewall and into which documents can be stacked to form a second stack of documents when the U-shaped container is in a second position which is different from the first position. The dual-stack document storage bin also comprises a mechanism operatively coupled between the first and second bottom walls to support substantially horizontal sliding movement of the U-shaped container between the first position in which documents can be stacked onto the first stack of documents in the first document storage chamber and the second position in which documents can be stacked onto the second stack of documents in the second document storage chamber.

DETAILED DESCRIPTION

The present invention is directed to a dual-stack document storage bin for use in a self-service bunch document depositing terminal, such as a bunch document depositing automated teller machine (ATM).

Figure 1:
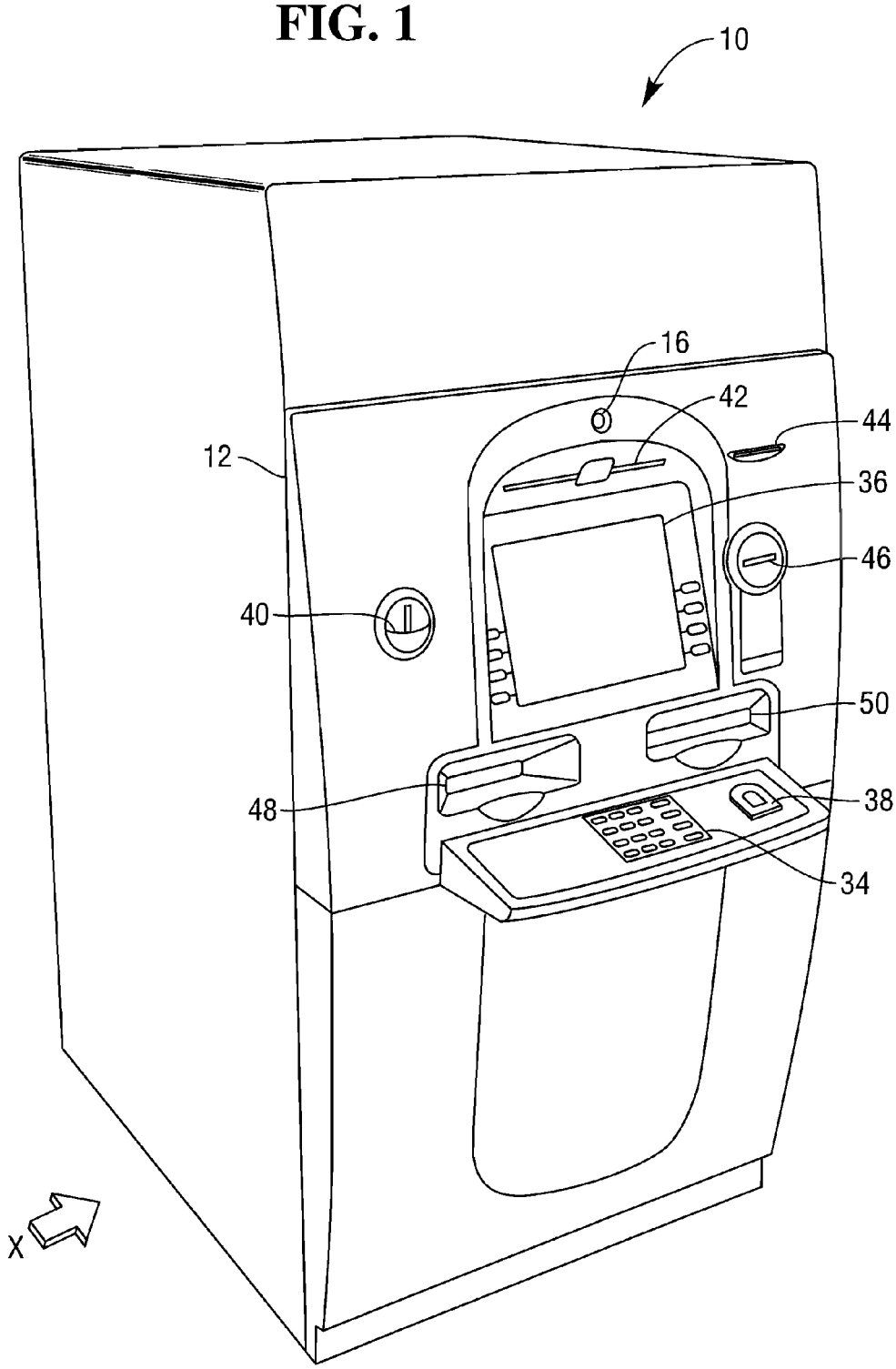
FIG. 1 is a left-front perspective view of a bunch document depositing automated teller machine (ATM) constructed in accordance with one embodiment of the present invention.

Referring to FIG. 1, a self-service bunch document depositing terminal in the form of an image-based bunch document depositing automated teller machine (ATM) 10 is illustrated. The check depositing ATM 10 comprises a fascia 12 coupled to a chassis (not shown). The fascia 12 defines an aperture 16 through which a camera (not shown) images a customer of the ATM 10. The fascia 12 also defines a number of slots for receiving and dispensing media items, and a tray 40 into which coins can be dispensed. The slots include a statement output slot 42, a receipt slot 44, a card reader slot 46, a cash slot 48, and a bunch document input/output slot 50. The slots 42 to 50 and tray 40 are arranged such that the slots and tray align with corresponding ATM modules mounted within the chassis of the ATM 10.

The fascia 12 provides a user interface for allowing an ATM customer to execute a transaction. The fascia 12 includes an encrypting keyboard 34 for allowing an ATM customer to enter transaction details. A display 36 is provided for presenting screens to an ATM customer. A fingerprint reader 38 is provided for reading a fingerprint of an ATM customer to identify the ATM customer. The user interface features described above are all provided on an NCR PERSONAS (trademark) 6676 ATM, available from NCR Financial Solutions Group Limited, Discovery Centre, 3 Fulton Road, Dundee, DD2 4SW, Scotland.

Figure 2:
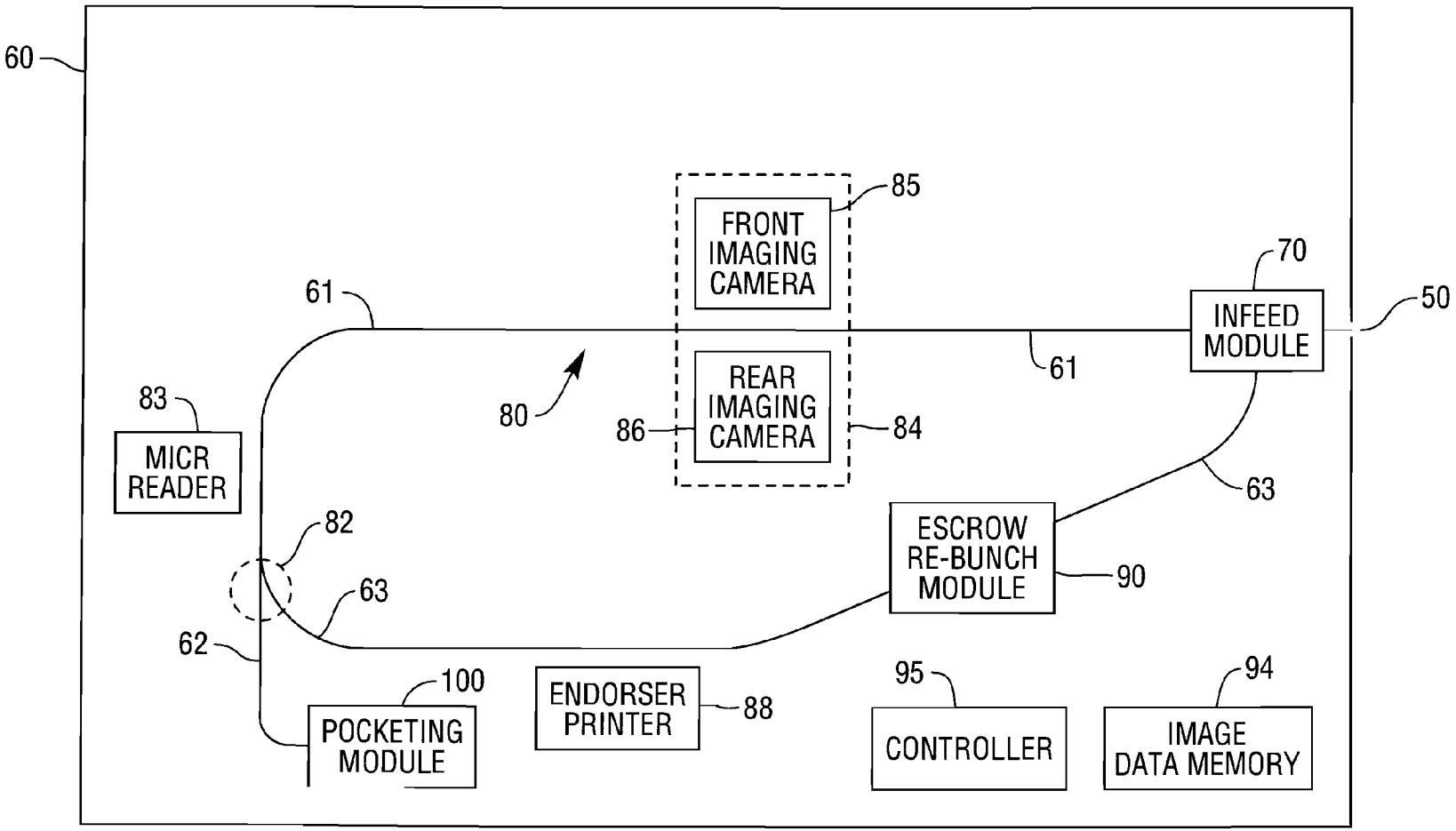
FIG. 2 is a simplified schematic diagram, looking approximately in the direction of arrow "X" in FIG. 1, and illustrating a scalable deposit module (SDM) configured to operate in the ATM of FIG. 1.
Figure 3:
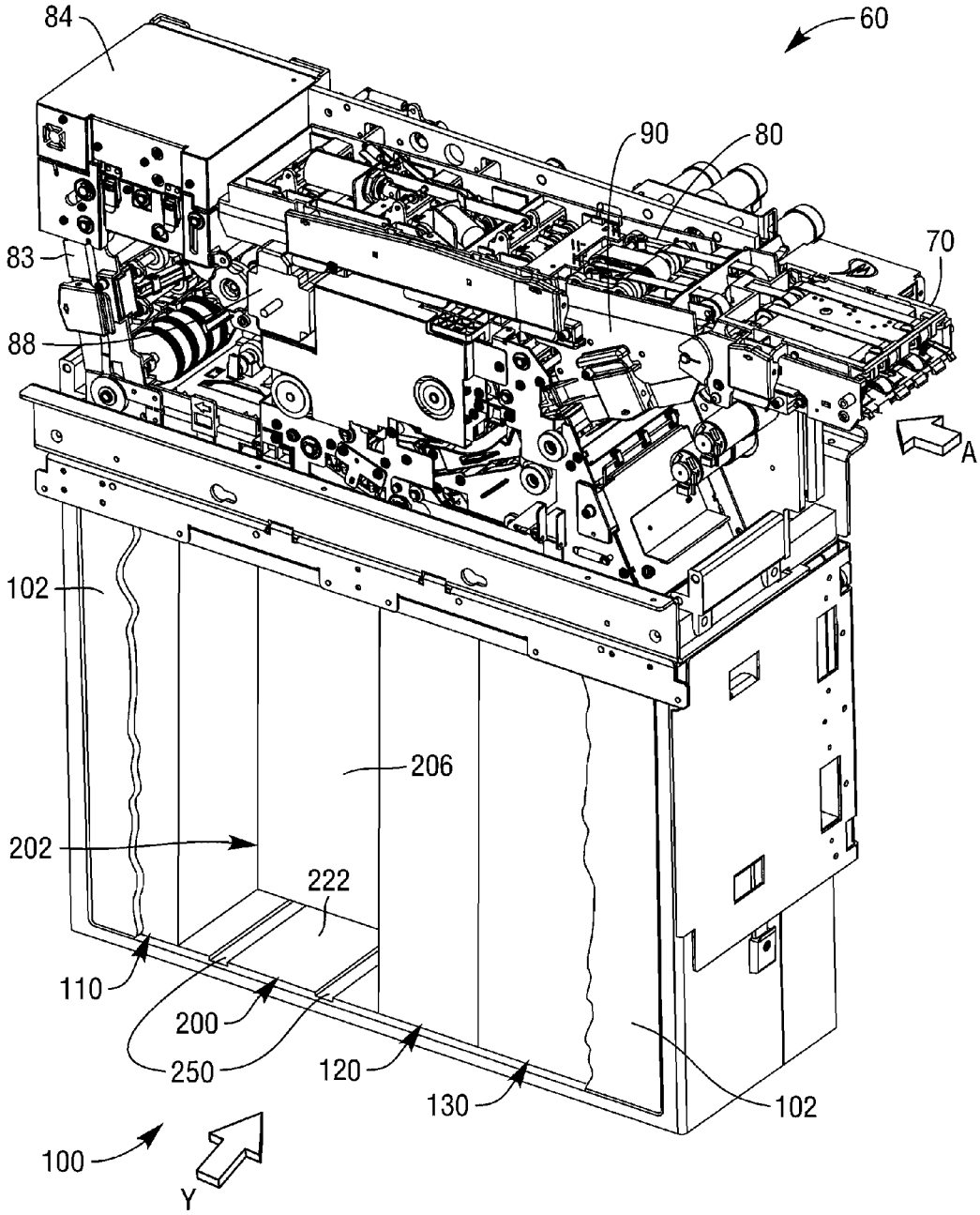
FIG. 3 is a left-front perspective view of the SDM of FIG. 2 with an enclosure panel of a pocketing module broken away to better illustrate details of the pocketing module.

Referring to FIGS. 2 and 3, one embodiment of a scalable deposit module (SDM) 60 is illustrated. FIG. 2 is a simplified schematic diagram (looking approximately in the direction of arrow "X" in FIG. 1) of part of the fascia 12 and main parts of the SDM 60. FIG. 3 is a left-front perspective view of the SDM 60 shown in FIG. 2.

The SDM 60 of FIGS. 2 and 3 comprises four main units which include an infeed module 70, a transport module 80, an escrow re-bunch module (ERBM) 90, and pocketing module 100. The infeed module 70 receives a bunch of documents deposited into the bunch document input/output slot 50, and transports the documents one-by-one to an inlet of the transport module 80. The dimensions of the infeed module 70, such as its run length, may vary depending upon the particular model ATM the SDM 60 is installed. The structure and operation of the infeed module 70 are conventional and well known and, therefore, will not be described.

The transport module 80 includes a document transport mechanism which receives a document from the inlet adjacent to the infeed module 70, and transports the document along a first document track portion 61 which is the main track portion. The transport module 80 further includes a document diverter 82 which is operable to divert a document along a second document track portion 62 to the pocketing module 100, and a third document track portion 63 which leads to the ERBM 90 and then back to the infeed module 70. The third document track 63 allows a bunch of documents which has accumulated in the ERBM 90 to be transported back to the infeed module 70. The structure and operation of diverter 82 shown in FIG. 2 may be any suitable diverter which is capable of diverting a document along one of two different document transport paths. The structure and operation of diverter 82 are conventional and well known and, therefore, will not be described.

The transport module 80 further includes a magnetic ink character recognition (MICR) head 83 for reading magnetic details on a code line of a check. The transport module 80 also includes an imager 84 including a front imaging camera 85 and a rear imaging camera 86 for capturing an image of each side of a check (front and rear). An endorser printer 88 is provided for printing endorsements onto checks. An image data memory 94 is provided for storing images of checks. A controller 95 is provided for controlling the operation of the elements within the SDM 60.

The SDM 60 processes a bunch of documents of different types (such as currency notes, checks, or a combination thereof). When a bunch of documents is being processed, each document of the bunch is separated at the infeed module 70 before it is individually processed. The separated documents are fed into the infeed module 70 in the direction of arrow "A" shown in FIG. 3. Each processed document is then re-assembled at the ERBM 90 to bunch the documents back together. Bunch processing of different types of documents is sometimes referred to as "multiple-document processing". Since individual documents are being bunched back together, an escrow module (such as the ERBM 90 shown in FIGS. 2 and 3) is needed. The ERBM 90 is manufactured and available from Glory Products, located in Himeji, Japan. The ERBM 90 allows a bunch of documents to be processed in a single transaction. If a bunch of documents has accumulated in the ERBM 90 and is unable to be processed further within the SDM 60, then the bunch of documents is transported via the third document track portion 63 back to the infeed module 70 to return the unprocessed bunch of documents to the ATM customer.

Figure 4:
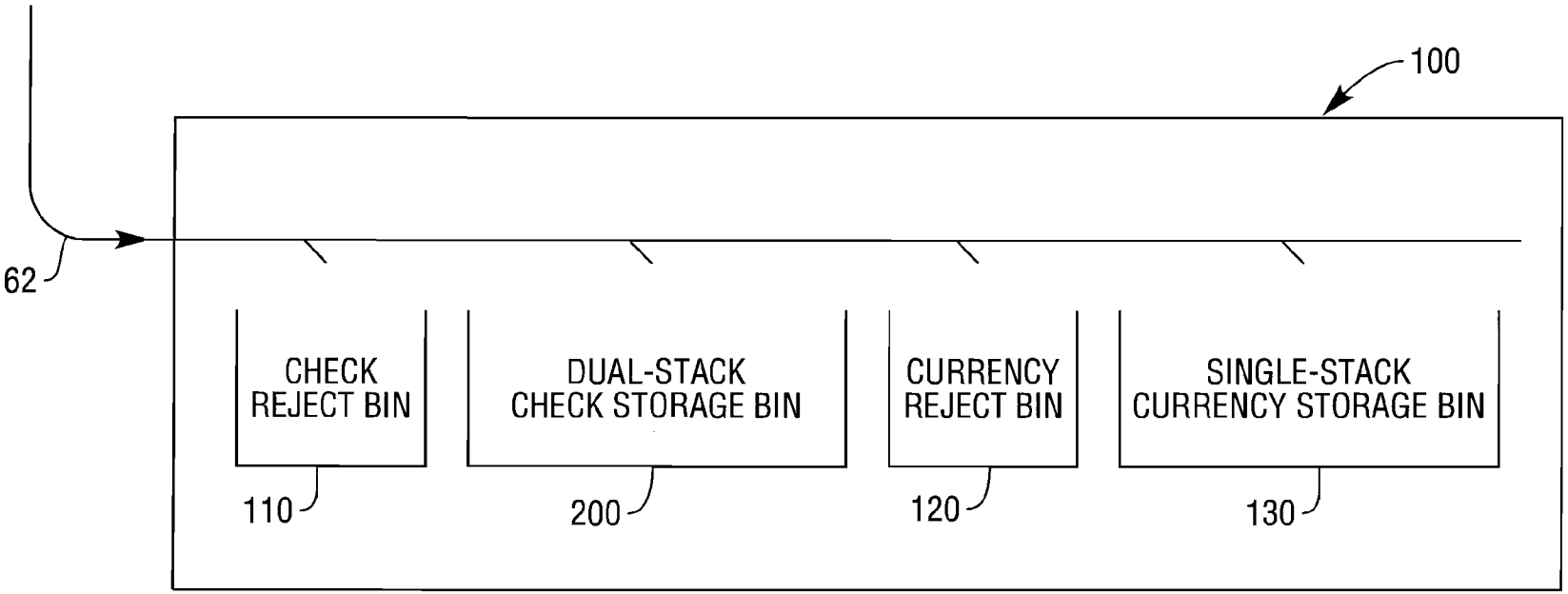
FIG. 4 is a simplified schematic diagram, looking approximately in the direction of arrow "Y" in FIG. 3, and showing components of the pocketing module.

Referring to FIG. 3, an enclosure panel 102 of the pocketing module 100 is shown broken away. FIG. 4 is a simplified schematic diagram, looking approximately in the direction of arrow "Y" in FIG. 3, and showing components of the pocketing module. As shown in FIGS. 3 and 4, the pocketing module 100 includes a check reject bin 110, a dual-stack check storage bin 200, a currency reject bin 120, and a single-stack currency storage bin 130. The single-stack currency storage bin 130 stores successfully-processed currency notes. The check reject bin 110 stores rejected checks, and the currency reject bin 120 stores rejected currency notes. Each of the reject bins 110, 120 is smaller than the single-stack currency storage bin 130. Structure and operation of the single-stack currency storage bin 120 are known and, therefore, will not be described. Also, structure and operation of the check reject bin 110 and the currency reject bin 120 are known and, therefore, will not be described.

Figure 5:
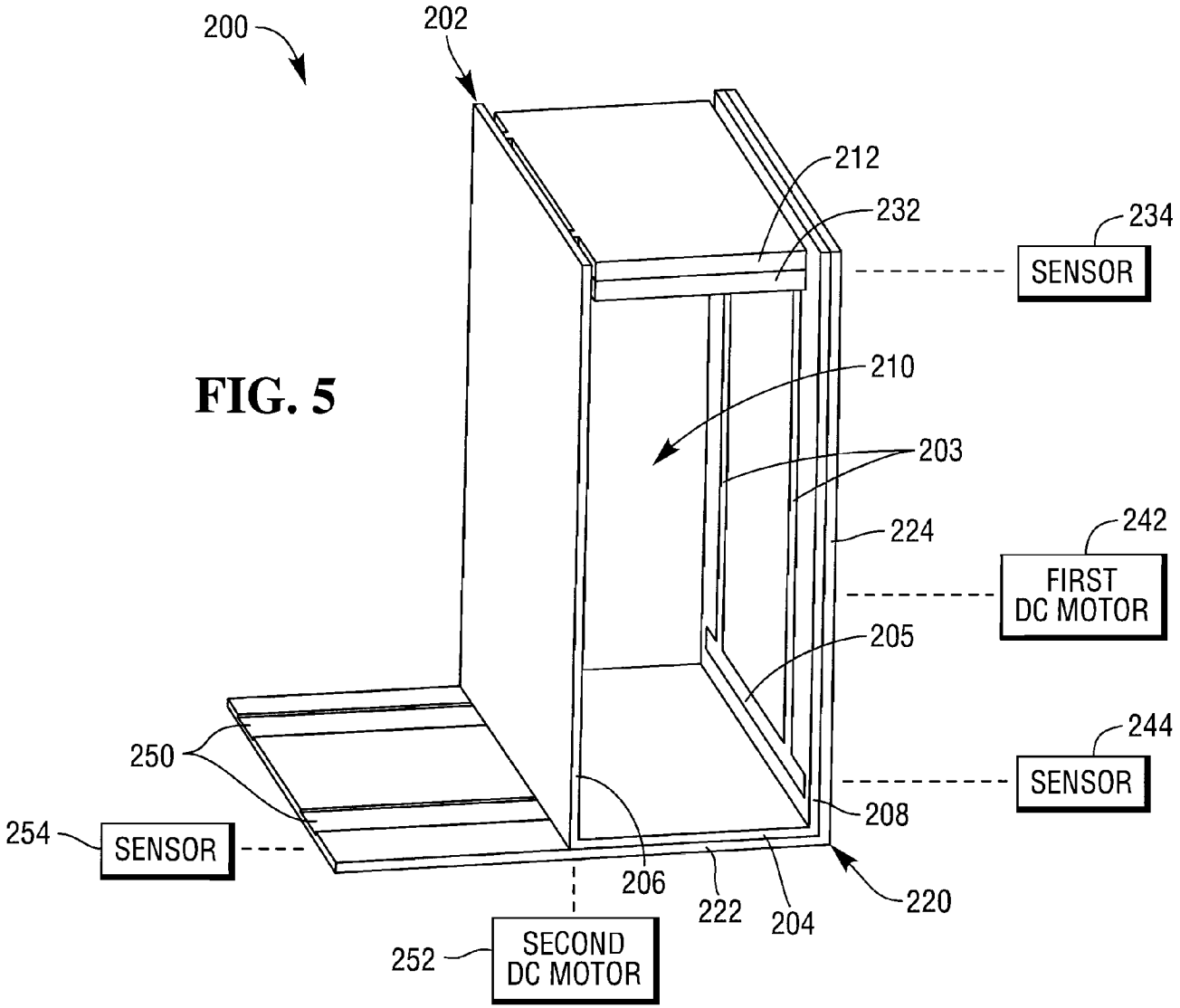
FIG. 5 is a somewhat schematic view of a dual-stack document storage bin which can be used in the pocketing module of FIG. 4, and which is constructed in accordance with one embodiment of the present invention.

Referring to FIGS. 3 and 5, one embodiment of the dual-stack check storage bin 200 is illustrated. The check storage bin 200 stores successfully-processed checks. The check storage bin 200 includes a substantially U-shaped container 202 having a first bottom wall 204 (FIG. 5) which interconnects a first sidewall 206 and a second sidewall 208 to provide the substantially U-shape. The first bottom wall 204 and the first and second sidewalls 206, 208 form a first document storage chamber 210 which is defined between the first and second sidewalls and into which checks can be stacked to form a first stack of checks when the U-shaped container 202 is in a first position as shown in FIG. 5. The check storage bin 200 further includes a substantially L-shaped housing 220 which has a second bottom wall 222 and a third sidewall 224 which is disposed relative to the second bottom wall to provide the substantially L-shape.

As shown in FIG. 5, a first stacking plate 212 is disposed in the first document storage chamber 210. The first plate 212 supports the first stack checks when the U-shaped container 202 is in the first position shown in FIG. 5. Also, as shown in FIG. 5, a second stacking plate 232 is located beneath the first stacking plate 212. The first and second plates 212, 232 are disposed in an overlapping relationship relative to each other when the U-shaped container is in the first position shown in FIG. 5. The second stacking plate 232 is also disposed in the first chamber 210 when the U-shaped container 202 is in the first position shown in FIG. 5.

Figure 7:
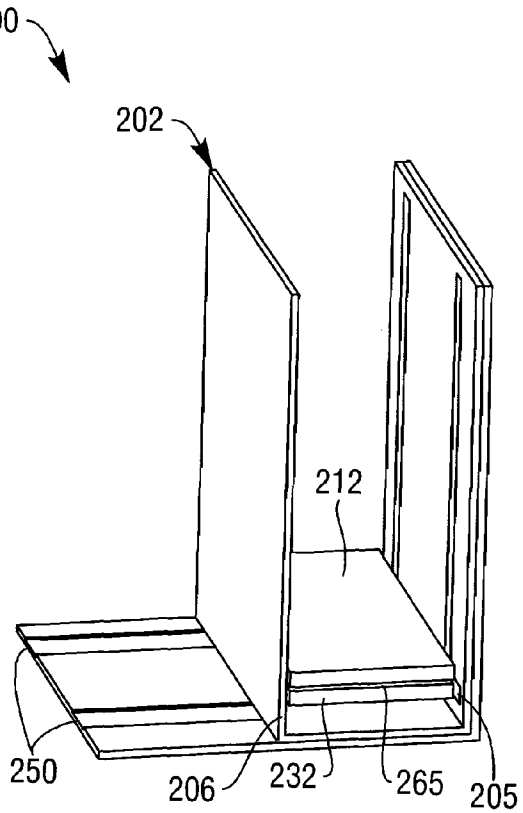
Figure 6:
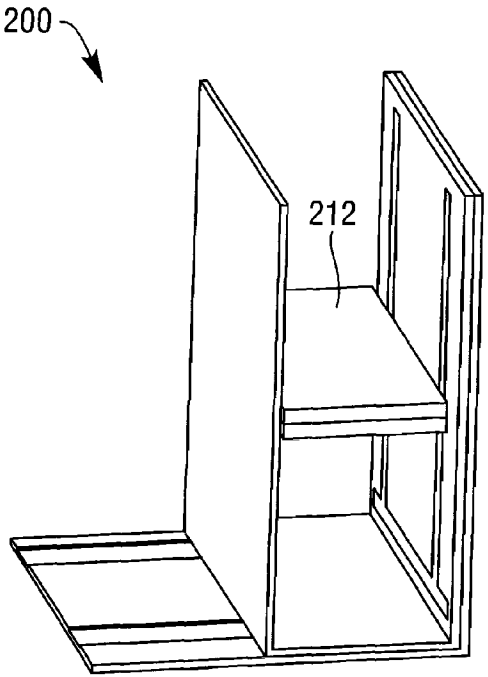

The first plate 212 is a passive plate in that it floats inside of the U-shaped container 202. The first plate 212 is moveable from a topmost position (as shown in FIG. 5) through an intermediate position such as shown in FIG. 6 to a bottommost position (as shown in FIG. 7). More specifically, the first plate 212 is moveable between the topmost and bottommost positions along a pair of parallel, longitudinally-extending slots (not shown) which are disposed on the inner surface of the first sidewall 206 of the U-shaped container 202. The first plate 212 floats between the topmost position of FIG. 5 and the bottommost position of FIG. 7.

Referring again to FIG. 5, a generally rectangular-shaped horizontal opening 205 is formed in the second sidewall 208 of the U-shaped container 202. The horizontal opening 205 is located below a pair of vertically-extending openings 203 which are also formed in the second sidewall 208 of the U-shaped container 202. The horizontal opening 205 has a size through which the second plate 232 can pass through, as will be described in detail later.

Figure 8:
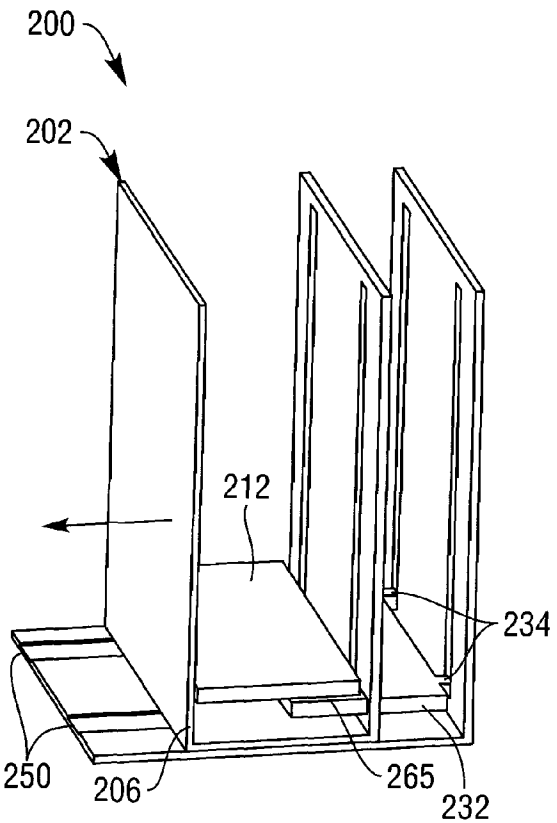
FIGS. 6-9 are views similar to FIG. 5, and showing parts in different positions.

The second plate 232 is an active plate in that it moves under motor power inside of the U-shaped container 202. The second plate 232 moves under motorized power between its top position (as shown in FIG. 5) and its bottommost position (as shown in FIG. 7). More specifically, the second plate 232 is drivingly coupled through a first mechanism 240 (see FIG. 9) which is disposed on the third sidewall 224 of the housing 220 to a first direct current (DC) motor 242 (shown only in FIG. 5). The vertically-extending openings 203 provide the necessary clearance for extension arms 234 (see FIGS. 8 and 9) of the second plate 232 to pass through as the second plate moves between its top and bottommost positions.

The controller 95 (FIG. 2) controls operation of the first DC motor 242 to effect movement of the second plate 232 between its topmost and bottommost positions. Since the first plate 212 is passive and lies on top of the active second plate 232, the first plate moves together with movement of the active second plate 232. It should be noted that there is a stop (not shown) which is disposed on the inner surface of the first sidewall 206 of the U-shaped container 202 to prevent the first plate 212 from contacting the second plate 232 when the second plate 232 is in its bottommost position shown in FIG. 7. Accordingly, there is a tiny gap 265 between the first and second plates 212 and 232 when the second plate 232 is in its bottommost position shown in FIG. 7.

As shown in FIG. 5, a second mechanism 250 is operatively coupled between the first bottom wall 204 of the container 202 and the second bottom wall 222 of the housing 220. The second mechanism 250 supports substantially horizontal sliding movement of the container 202 from the position shown in FIG. 7 through an intermediate position shown in FIG. 8 to a position shown in FIG. 9. More specifically, the container 202 is drivingly coupled through the second mechanism 250 to a second DC motor 252 (shown only in FIG. 5). The horizontal opening 205 provides the necessary clearance for the second plate 232 to pass through as the U-shaped container 202 together with the first plate 212 move from the position shown in FIG. 7 to the position shown in FIG. 9.

Figure 9:
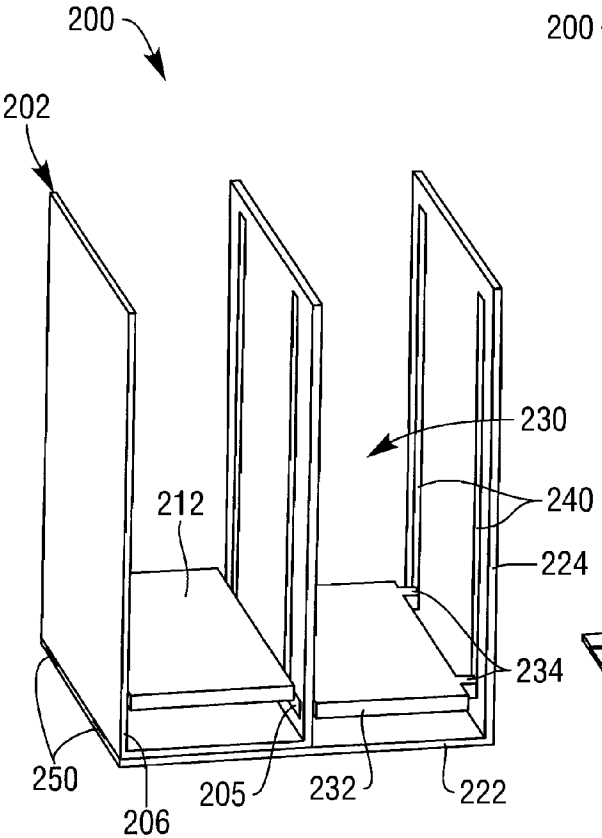

When the U-shaped container 202 is in the position shown in FIG. 9, a second document storage chamber 230 is formed. More specifically, the second bottom wall 222 and the third sidewall 224 form therebetween the second document storage chamber 230. Checks can be stacked to form a second stack of checks in the second chamber 230 when the U-shaped container 202 is in the position shown in FIG. 9.

Figure 10:
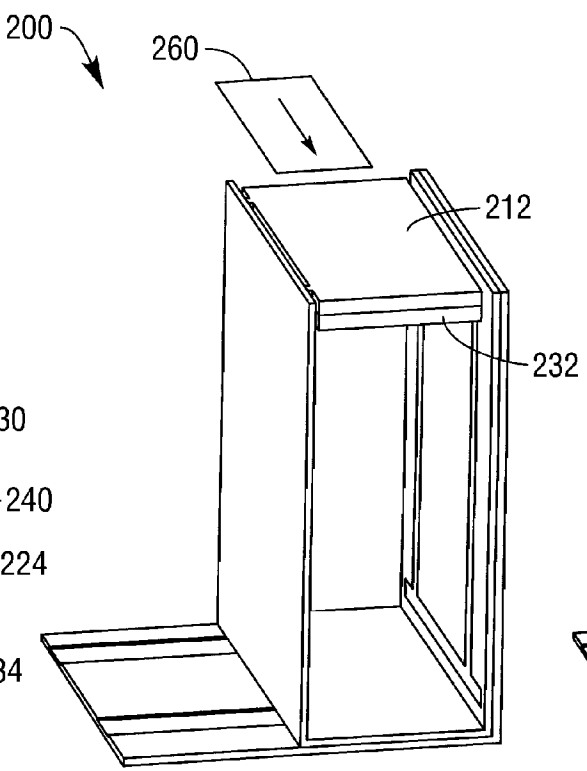

Referring to FIGS. 10-19, typical operation of the dual-stack check storage bin 200 will now be described. As shown in FIG. 10, a single check 260 directed to the dual-stack check storage bin 200 is deposited onto the first plate 212 in the first document chamber 210. A sensor 234 (shown only in FIG. 5) detects presence of the check 260 and provides an electrical signal indicative thereof. In response to the electrical signal, the controller 95 (FIG. 2) controls the first DC motor 242 (FIG. 5) to move the second plate 232 downwards until the sensor 234 no longer provides the electrical signal. It should be noted that the particular sensor and the particular technique used to sense presence of the check 260 are not important to the present invention.

Figure 11:
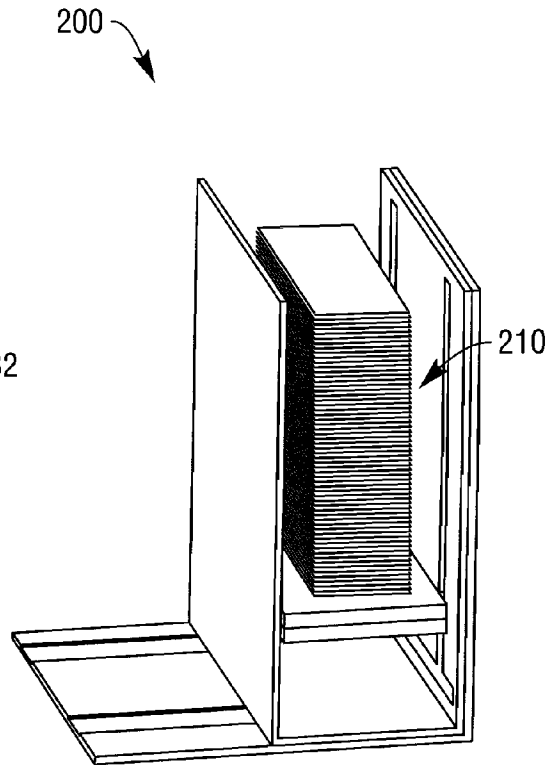
FIGS. 10-19 are views similar to FIG. 5, and showing parts in different positions during operation of the dual-stack document storage bin.

As shown in FIG. 11, a number of checks are stacked in the first document chamber 210 to form a first stack of checks. The first DC motor 242 is controlled to move the second plate 232 down further each time another document is added to the top of the first stack of checks. Eventually, this first stack of checks in the first chamber 210 becomes full, as shown in FIG. 12.

Figure 13:
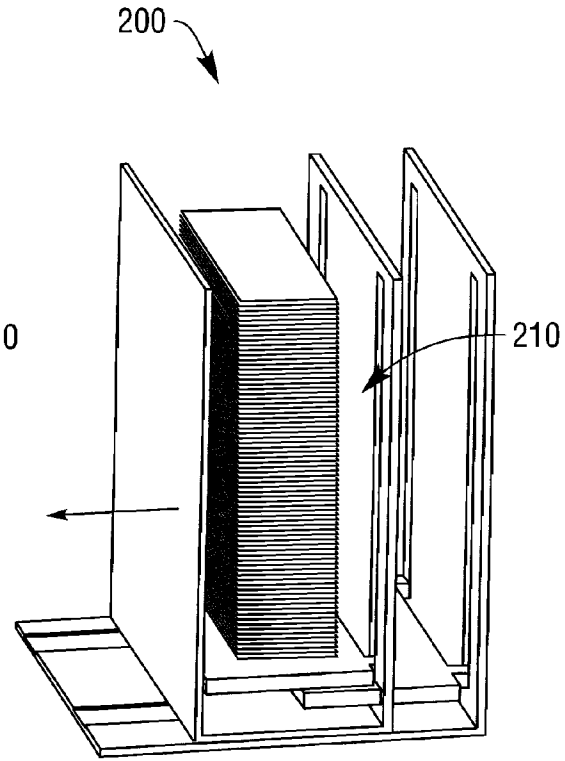
Figure 12:
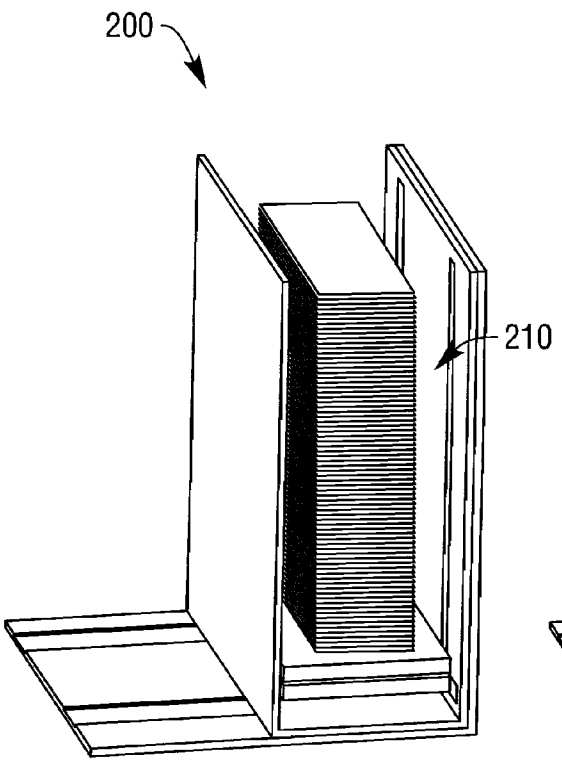

When the first chamber 210 is full with the first stack of documents as shown in FIG. 12, the second plate 232 is in its bottommost position. A sensor 244 (shown only in FIG. 5) detects that the second plate 232 has reached its bottommost position and provides an electrical signal indicative thereof. In response to the electrical signal from the sensor 244, the controller 95 (FIG. 2) controls the second DC motor 252 (FIG. 5) to move the U-shaped container 202 horizontally from the position shown in FIG. 12 through an intermediate position such as shown in FIG. 13 to the position shown in FIG. 14.

Figure 14:
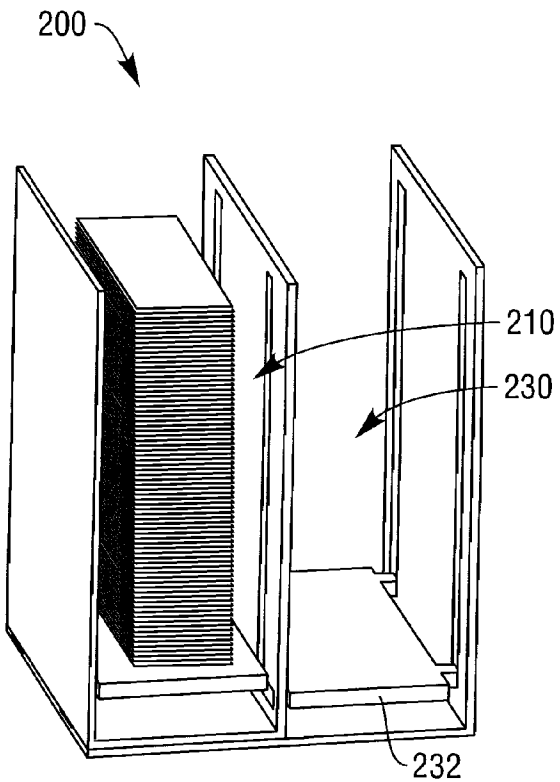
Figure 15:
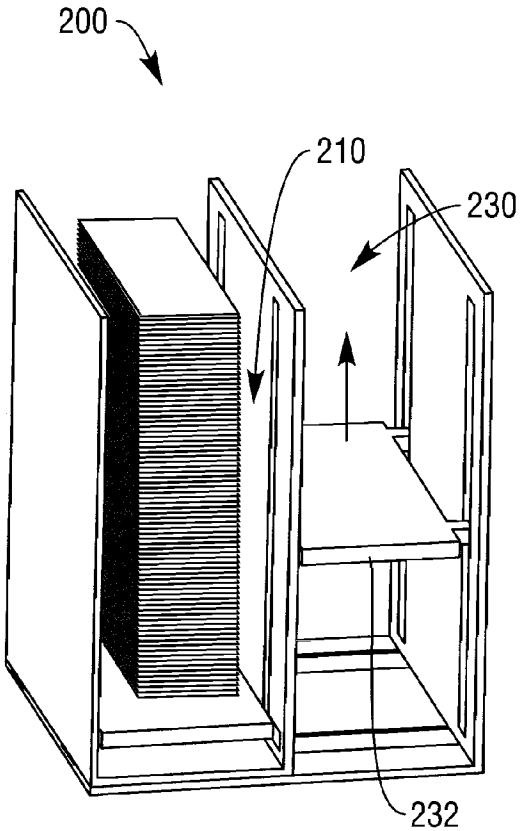

It should be apparent that the second document chamber 230 is formed when the U-shaped container 202 is in the position shown in FIG. 14. A sensor 254 (shown only in FIG. 5) detects that the U-shaped container 202 has reached its position shown in FIG. 14 and provides an electrical signal indicative thereof. In response to the electrical signal from the sensor 254, the controller 95 (FIG. 2) controls the first DC motor 242 (FIG. 5) to move the second plate 232 vertically from the position shown in FIG. 14 through an intermediate position such as shown in FIG. 15 to the position shown in FIG. 16. The second plate 232 is now in position to receive checks in the second chamber 230 to form a second stack of checks.

Figure 17:
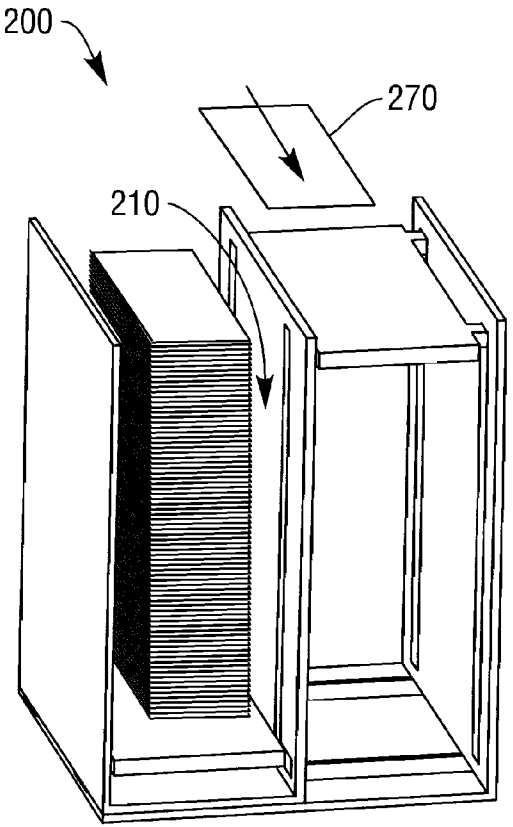
Figure 16:
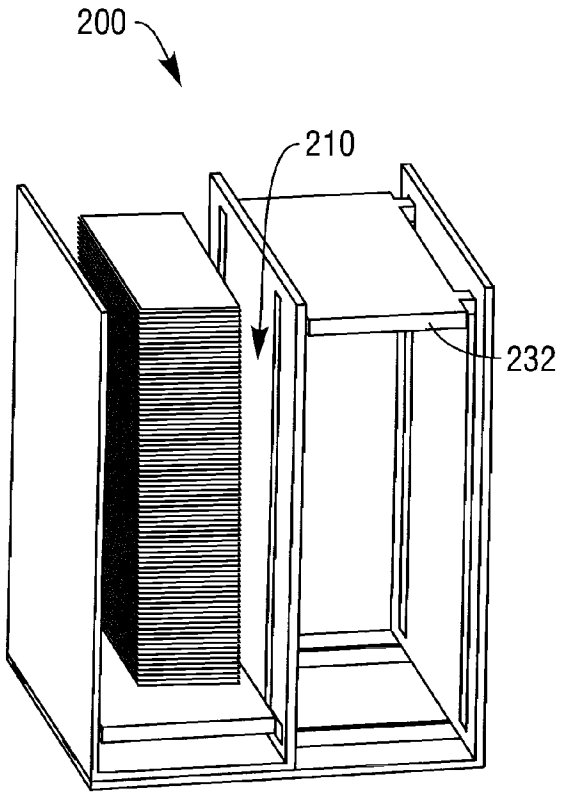

As shown in FIG. 17, a single check 270 directed to the dual-stack check storage bin 200 is deposited onto the second plate 232 in the second document chamber 230. The sensor 234 (FIG. 5) detects presence of the check 270 and provides an electrical signal indicative thereof. In response to the electrical signal, the controller 95 (FIG. 2) controls the first DC motor 242 (FIG. 5) to move the second plate 232 downwards until the sensor 234 no longer provides the electrical signal.

Figure 18:
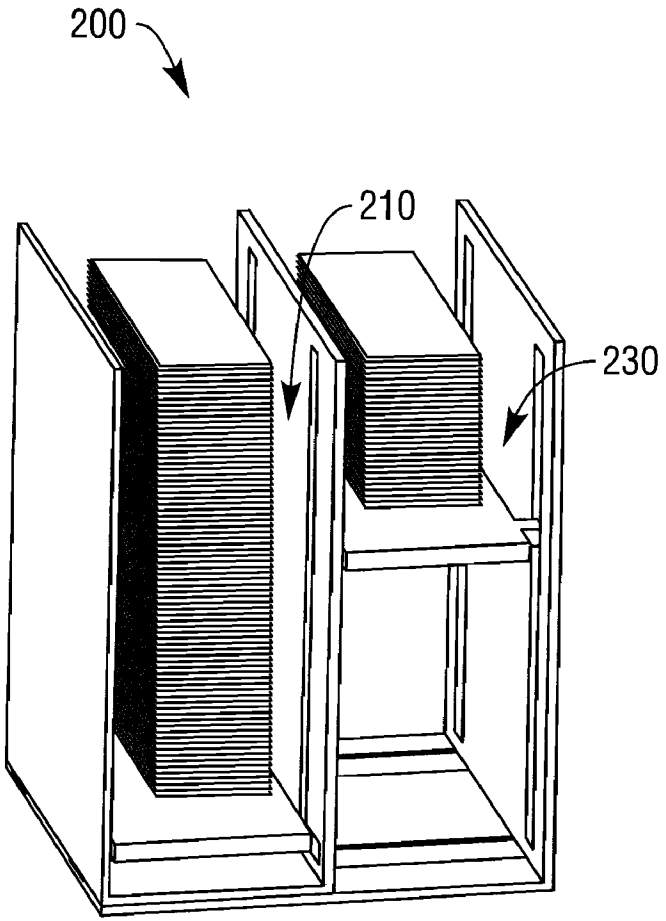

As shown in FIG. 18, a number of checks are stacked in the second document chamber 230 to form the second stack of checks. The first DC motor 242 is controlled to move the second plate 232 down further each time another check is added to the top of the second stack of checks. Eventually, this second stack of checks in the second chamber 230 becomes full, as shown in FIG. 19.

Figure 19:
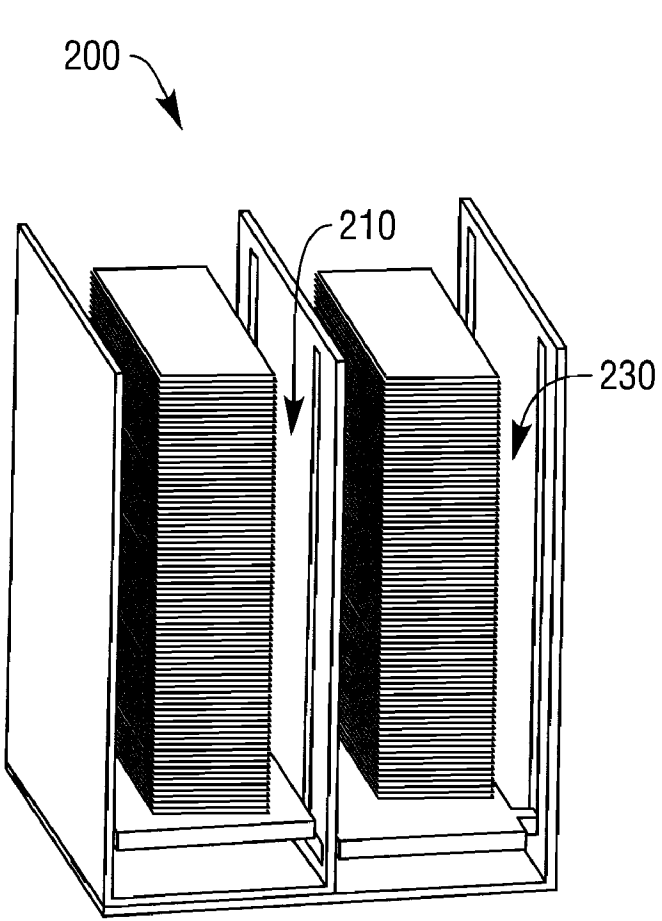

When the second stack of checks in the second chamber 230 becomes full as shown in FIG. 19, both the first stack of checks in the first chamber 210 and the second stack of checks in the second chamber 230 need to be emptied. After the first and second chambers 210, 230 have been emptied, the U-shaped container 202 and the first and second plates 212, 232 can be restored to their initial positions shown in FIG. 10. This restoration of parts to their initial positions shown in FIG. 10 can performed either manually or automatically, without human intervention. If performed automatically, then the controller, sensors, and motors cooperate together to accomplish the restoration.

It should be apparent that the check storage capacity of the pocketing module 100 is effectively doubled without having to increase height or depth of a conventional-sized check storage bin. Space available for width expansion of the conventional-sized check storage bin has been utilized to provide the doubled storage capacity. Since this space available for width expansion would otherwise be unused, the footprint and volume of the pocketing module 100 need not be increased to accommodate the dual-stack check storage bin 200. Accordingly, the dual-stack check storage bin 200 has a compactness which allows it to fit into a space where it is not possible to fit two single-stack check storage bins.

It should also be apparent that advantages in cost, reliability, and performance are achieved when the above-described dual-stack check storage bin 200 is used. For example, cost is reduced since there is only one stacking mechanism needed for two stacks of checks. As another example, reliability is improved since no additional storage bin interfaces or document diverter gates are needed. As another example, performance is not degraded since the length of the document transport path does not have to be increased to accommodate an additional document storage bin. It should be noted that a longer document transport path would increase the time required for a customer to complete an ATM transaction and, therefore, degrade performance.

Although the above-description describes the PERSONAS (trade mark) 6676 NCR ATM in accordance one embodiment of the present invention, it is conceivable that other models of ATMs, other types of ATMs, or other types of self-service terminals may embody the present invention. It is also conceivable that the self-service terminal may be any type of device in a publicly accessible, unattended environment, such as a check depositing ATM, a check depositing/cashing ATM, a check cashing ATM, or the like. Self-service terminals are generally public-access devices that are designed to allow a user to conduct a transaction or to access information in an unassisted manner and/or in an unattended environment. Self-service terminals typically include some form of tamper resistance so that they are inherently resilient. Self-service terminals allow users to obtain information or to conduct a transaction. Self-service terminals include: ATMs; non-cash kiosks that allow users to access information (e.g., to view reward points on a reward card the user inserts into the self-service terminal); and kiosks that accept payment for services (e.g. Web surfing kiosks, kiosks that allow users to buy goods, etc.). The term self-service terminal has a relatively broad meaning and includes vending machines.

Although the above-description describes only the check storage bin 200 as being a type of dual-stack document storage bin constructed in accordance with one embodiment of the present invention, it is conceivable that the currency storage bin also be of this type of construction. Moreover, it is conceivable that only the currency storage bin is of this type of construction, and that the check storage bin is of conventional construction.

Also, although the above-description describes a financial document in the form of a check or currency being deposited, it is contemplated other types of financial documents may be deposited. Moreover, it is conceivable that non-financial documents may be deposited. Documents may be of different sizes, different thicknesses, or different weights of paper.

Further, although the above-description describes using a DC motor to effect movement of a plate between its top and bottom positions, it is conceivable that other types of motors or moving mechanisms may be used to effect movement of the plate.

The particular arrangements disclosed are meant to be illustrative only and not limiting as to the scope of the invention. From the above description, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A dual-stack document storage bin comprising:

a substantially U-shaped container including a first bottom wall which interconnects first and second sidewalls to provide (i) the substantially U-shape, and (ii) a first document storage chamber which is defined between the first and second sidewalls and into which documents can be stacked to form a first stack of documents when the U-shaped container is in a first position;

a substantially L-shaped housing including a second bottom wall and a third sidewall which is disposed relative to the second bottom wall to provide (i) the substantially L-shape, and (ii) a second document storage chamber which is defined between the third side wall and the second sidewall and into which documents can be stacked to form a second stack of documents when the U-shaped container is in a second position which is different from the first position; and a mechanism operatively coupled between the first and second bottom walls to support substantially horizontal sliding movement of the U-shaped container between the first position in which documents can be stacked onto the first stack of documents in the first document storage chamber and the second position in which documents can be stacked onto the second stack of documents in the second document storage chamber.

2. A dual-stack document storage bin according to claim 1, further comprising (i) a first stacking plate disposed in the first document storage chamber and on which the first stack documents is supported when the U-shaped container is in the first position, and (ii) a second stacking plate disposed in the second document storage chamber and on which the second stack documents is supported when the U-shaped container is in the second position.

3. A dual-stack document storage bin according to claim 2, wherein (i) the first and second plates are disposed in an overlapping relationship relative to each other when the U-shaped container is in the first position, and (ii) the first and second plates are disposed in a non-overlapping relationship relative to each other when the U-shaped container is in the second position.

4. A dual-stack document storage bin according to claim 3, wherein the first plate lies on top of the second plate when the U-shaped container is in the first position.

5. A dual-stack document storage bin according to claim 4, further comprising:

another mechanism operatively coupled between the second plate and the third sidewall of the L-shaped housing to support substantially vertical sliding movement of the second plate between a third and a fourth position.

6. A dual-stack document storage bin according to claim 5, wherein the fourth position of the second plate corresponds to a bottommost position of the second plate along the third sidewall of the L-shaped housing.

7. A dual-stack document storage bin comprising:

a document storage housing having a bottom wall portion and a sidewall portion;

a document storage container having a bottom wall portion which interconnects first and second leg wall portions on opposite sides of the bottom wall portion;

a mechanism disposed between the bottom wall portion of the housing and the bottom wall portion of the container and for supporting the container for substantially horizontal sliding movement relative to the sidewall portion of the housing between (i) a first position in which the first leg wall portion of the container is adjacent to the sidewall portion of the housing so that documents can be stacked into a first stack of documents in the container and (ii) a second position in which the first leg wall portion of the container is spaced apart from the sidewall portion of the housing portion by at least a width of a document to be stacked into the container so that documents can be stacked into a second stack of documents between the first leg wall portion of the container and the sidewall portion of the housing.

8. A document storage apparatus comprising:

a document storage housing having a bottom wall portion and a sidewall portion;

a bottom document stacking plate moveable between a top vertical position and a bottom vertical position;

a first mechanism operatively coupled between the sidewall portion of the housing and the bottom plate to support the bottom plate for substantially vertical sliding movement between its top and bottom vertical positions;

a document storage container having a bottom wall portion and a sidewall portion which is parallel to the sidewall portion of the housing;

a top document stacking plate disposed in the container and moveable between a top vertical position in which the top plate is substantially empty of documents and a bottom vertical position in which the top plate is substantially full of documents; and a second mechanism operatively coupled between the bottom wall portion of the container and the bottom wall portion of the housing to support the container for substantially horizontal sliding movement of the container between a first horizontal position in which documents can be stacked onto the top plate in the container to form a first stack of documents and a second horizontal position in which documents can be stacked onto the bottom plate to form a second stack of documents.

9. A document storage apparatus according to claim 8, wherein (i) the top and bottom plates are disposed in an overlapping relationship relative to each other when the container is in the first horizontal position, and (ii) the top and bottom plates are disposed in a non-overlapping relationship relative to each other when the container is in the second horizontal position.

10. A document storage apparatus according to claim 9, wherein the top plate lies on top of the bottom plate when the container is in the first horizontal position.

* * * * *